US008696158B2

(12) United States Patent
Santiago et al.

(10) Patent No.: US 8,696,158 B2
(45) Date of Patent: Apr. 15, 2014

(54) LED UNIVERSAL RECESSED LIGHT FIXTURE

(75) Inventors: Dwight David Santiago, Summerfield, NC (US); James Madden, Philadelphia, PA (US); Seth Chang, Rowland Heights, CA (US); Edmond Daniels, Santa Clarita, CA (US); Daniel Dix, Irvine, CA (US); Huan C. Nguyen, Anaheim, CA (US)

(73) Assignee: Cordelia Lighting, Inc., Rancho Dominguez, CA (US)

( * ) Notice: Subject to any disclaimer, the term of this patent is extended or adjusted under 35 U.S.C. 154(b) by 154 days.

(21) Appl. No.: 13/007,534

(22) Filed: Jan. 14, 2011

(65) Prior Publication Data

US 2012/0182744 A1 Jul. 19, 2012

(51) Int. Cl.
*F21S 4/00* (2006.01)
*F21V 21/00* (2006.01)

(52) U.S. Cl.
USPC ..... 362/249.02; 362/294; 362/365; 362/373; 362/800

(58) Field of Classification Search
USPC ..... 362/240, 249.02, 364–373, 800, 294
See application file for complete search history.

(56) References Cited

U.S. PATENT DOCUMENTS

| | | | | |
|---|---|---|---|---|
| D573,294 | S | 7/2008 | Chan | |
| D596,330 | S | 7/2009 | Pickard | |
| D601,739 | S | 10/2009 | Chan | |
| 7,614,769 | B2 | 11/2009 | Sell | |
| 7,722,213 | B2 * | 5/2010 | Inoue et al. | 362/241 |
| 7,862,214 | B2 * | 1/2011 | Trott et al. | 362/365 |
| 7,959,332 | B2 | 6/2011 | Tickner | |
| 8,096,686 | B2 * | 1/2012 | Wilcox | 362/365 |
| 8,128,263 | B2 * | 3/2012 | Higuchi et al. | 362/373 |
| 2009/0080189 | A1 | 3/2009 | Wegner | |
| 2009/0086476 | A1 | 4/2009 | Tickner | |
| 2009/0129086 | A1 | 5/2009 | Thompson, III | |
| 2009/0284958 | A1 | 11/2009 | Pickard | |
| 2009/0290343 | A1 | 11/2009 | Brown | |
| 2009/0290361 | A1 | 11/2009 | Ruud | |
| 2010/0296272 | A1 | 11/2010 | Roos et al. | |
| 2011/0222291 | A1 * | 9/2011 | Peng | 362/294 |

FOREIGN PATENT DOCUMENTS

CA 2511296 A1 1/2001

OTHER PUBLICATIONS

Aug. 11, 2011, CIPO Examiner Report for Counterpart CA Application No. 2,741,071.

* cited by examiner

*Primary Examiner* — Jason Moon Han
(74) *Attorney, Agent, or Firm* — Paul Y. Feng; The Eclipse Group LLP

(57) ABSTRACT

A recessed LED ceiling light fixture kit for installation to a ceiling panel or plaster frame in residential homes or commercial buildings is disclosed. The kit includes an LED engine with at least one LED facing downward, an LED driver, and an annular shaped, finned heat sink that receives the LED driver therein and the LED underneath. The fixture includes a tubular-shaped can having an open bottom and a top engaging the heat sink. Detachable can retainer springs or threaded fasteners engage the can at its circumference, wherein the springs mount the can to the ceiling panel, or alternatively, the fasteners attach the can to the plaster frame. A trim ring is snapped onto the can at its open bottom, and an electrical junction box sits on top of the heat sink.

20 Claims, 6 Drawing Sheets

LED UNIVERSAL RECESSED LIGHT FIXTURE

BACKGROUND

Light fixtures recessed into the ceiling are popular in residential homes and commercial buildings. Recessed lighting fixtures provide a flush, aesthetic appearance that is attractive to many because the design hides the electrical hardware and wiring inside a space behind the ceiling. Typically, the light fixture comes in the form of a housing shaped like a can, and a light source with a reflective trim fitted inside the can. Wiring is fed into the can to power the light source. Mounting hardware attaches the can to the building frame, ceiling joists, or ceiling support structure.

In the era of high utility costs and consumer demands for more efficient lighting, the lighting industry is moving toward the use of Light Emitting Diodes (LED) to replace relatively high energy consuming incandescent bulbs, halogen bulbs, and the like, in light fixtures. Examples of ceiling light fixture that employ LEDs as the light source include: U.S. Pat. No. 7,614,769 (Sell); U.S. Patent Application Publication No. 2009/0080189 (Wegner); U.S. Patent Application Publication No. 2009/0086476 (Tickner); U.S. Patent Application Publication No. 2009/0129086 (Thompson); U.S. Patent Application Publication No. 2009/0284958 (Pickard); U.S. Patent Application Publication No. 2009/0290343 (Brown); U.S. Patent Application Publication No. 2009/0290361 (Ruud); U.S. Design Pat. No. D601,739 (Chan); U.S. Design Pat. No. D573,294 (Chan); and U.S. Design Pat. No. D596,330 (Pickard).

SUMMARY OF THE INVENTION

The present invention in various preferred embodiments is directed to a recessed LED light fixture kit for installation to a ceiling panel or a plaster frame. As such, the recessed LED light fixture kit of the present invention is suitable for either remodel applications (i.e., replacing a preexisting incandescent, fluorescent, or halogen recessed light fixture), or new construction applications (i.e., used in conjunction with a plaster frame in a new home or commercial building).

In a preferred embodiment, the recessed LED ceiling light fixture kit includes an LED engine with at least one LED facing downward and an LED driver; a heat sink, wherein the LED driver is disposed on the heat sink and the LED is disposed underneath; a tubular-shaped can with an open bottom and a top formed integrally with the heat sink in an unitary assembly with the LED facing toward the open bottom of the can; means for mounting disposed on the unitary assembly for mounting the unitary assembly to one of the ceiling panel or the plaster frame, wherein the means for mounting can be separated from the unitary assembly; a junction box disposed on the unitary assembly; and a trim ring attached to the open bottom of the can.

According to the preferred embodiment, the LED driver is recessed into the heat sink to save vertical space. Further, the can, the heat sink, or both have a very squat aspect ratio to save on vertical dimension. Hence, the recessed LED light fixture has a low profile with a height of about 6 inches or less. This compact vertical size allows remodel applications in older homes that have standard ceiling spaces where incandescent, fluorescent or halogen recessed light fixtures are used. The obsolete recessed light fixtures can be swapped out with the present invention recessed LED light fixture without need for major modification to the ceiling space.

The means for mounting includes pivoting can retainer springs for the remodel application, which retainer springs swivel into and out of the unitary assembly and anchor to the ceiling panel. Specifically, the retainer springs pivot into a deployed position and clamp down on the ceiling panel to which the light fixture is installed. Using the lip around the circumference of the trim ring, the ceiling panel is sandwiched between it and the deployed retainer springs. Alternatively, in a new construction application, the means for mounting preferably includes threaded fasteners that attach to the plaster frame, which plaster frame is then installed into the ceiling space in between the ceiling joists and above the ceiling. The ceiling panel, plaster frame, and the like form no part of the claimed invention and are mentioned only as a frame of reference.

The recessed ceiling light fixture preferably has an annular heat sink that may include radially, spaced apart, slat shaped fins with the fins having a wedge profile. This shape and arrangement improve the heat dissipation, which heat is generated by the LED and LED driver.

The trim ring includes a domed or cone shaped light reflector to help reflect light out of the fixture. An optional, optical grade lens can be fitted to the trim ring.

DETAILED DESCRIPTION OF THE PREFERRED EMBODIMENTS

The present invention in various preferred embodiments is directed to a recessed LED light fixture kit for installation to a ceiling panel or a plaster frame. As such, the present invention recessed LED light fixture kit is suitable for either remodel applications (i.e., replacing a preexisting incandescent, fluorescent, or halogen recessed light fixture), or new construction applications (i.e., used in conjunction with a plaster frame in a new home or commercial building).

The present invention recessed LED light fixture is designed to be highly compact in the vertical dimension. According to a preferred embodiment, the recessed LED light fixture has a low profile with a height of about 6 inches or less. This compact vertical size allows remodel applications in older homes that have standard ceiling spaces where incandescent, fluorescent, or halogen recessed light fixtures are used. These obsolete recessed light fixtures can be swapped out with the present invention recessed LED light fixture kit without need for major modification to the preexisting ceiling space, electrical wiring, or ceiling panel structure.

Moreover, the present invention recessed LED light fixture kit is designed to be modular so that it is easily converted to remodel or new construction applications with no modification to the existing ceiling space. The fixture is thus preferably commercialized in a kit for the consumer and used by the consumer for either the remodel or new construction application without need for searching for extra and specialized parts needed for that application.

Figure 3:
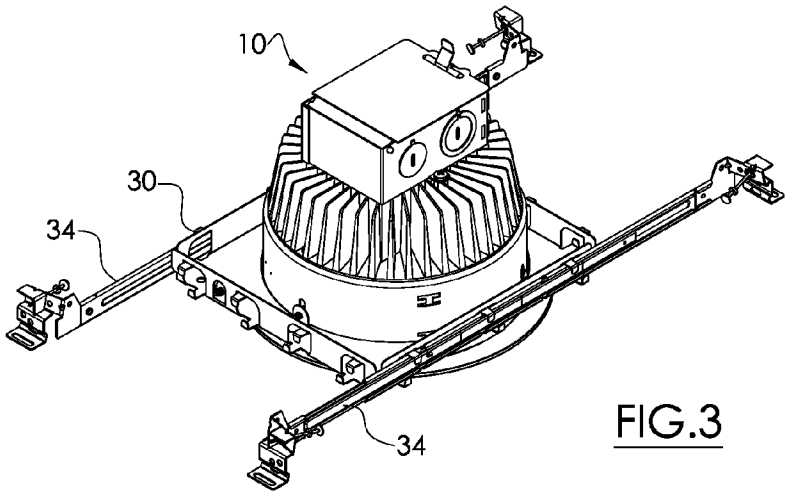
FIG. 3 is a top-looking-down perspective view of a preferred embodiment recessed LED light fixture kit assembled to a plaster frame for a new construction application.
Figure 4:
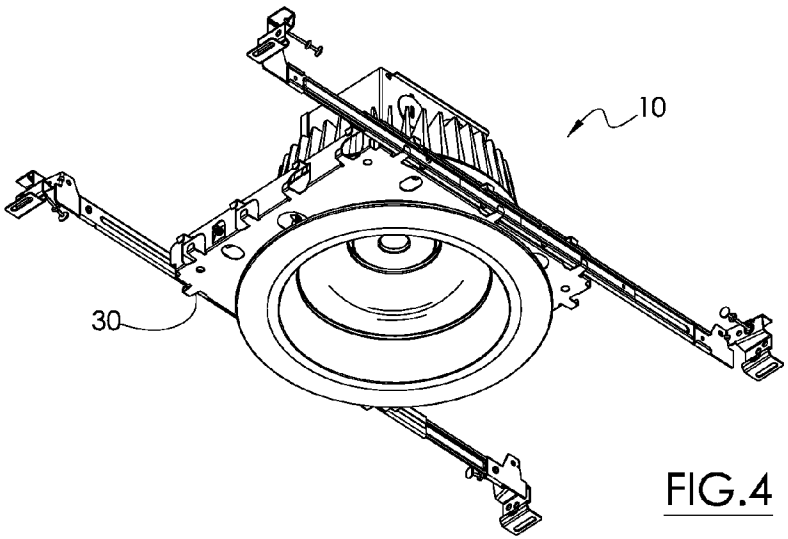
FIG. 4 is a bottom-looking-up perspective view of the FIG. 3 embodiment.
Figure 1:
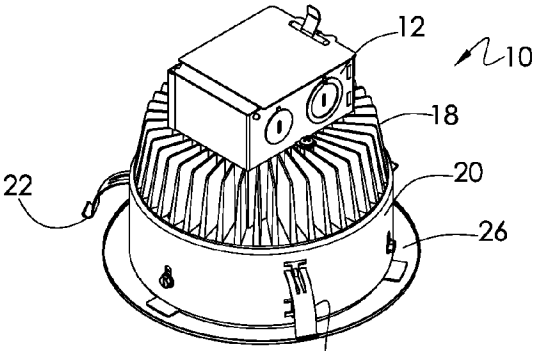
FIG. 1 is a top-looking-down perspective view of a preferred embodiment recessed LED light fixture kit for a remodel application.
Figure 2:
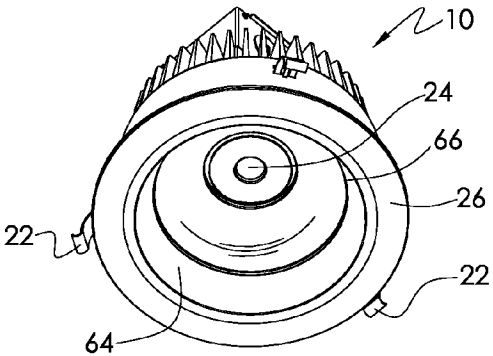
FIG. 2 is a bottom-looking-up perspective view of the FIG. 1 embodiment.

FIGS. 1-4 show a preferred embodiment of the present invention recessed LED light fixture kit 10. FIGS. 1, 2 show the light fixture kit 10 employed in a remodel application wherein the fixture has can retainer springs 22 for mounting to a ceiling panel or tile. FIGS. 3, 4 show the light fixture 10 joined to a plaster frame 30 intended for a new construction application.

Figure 13:
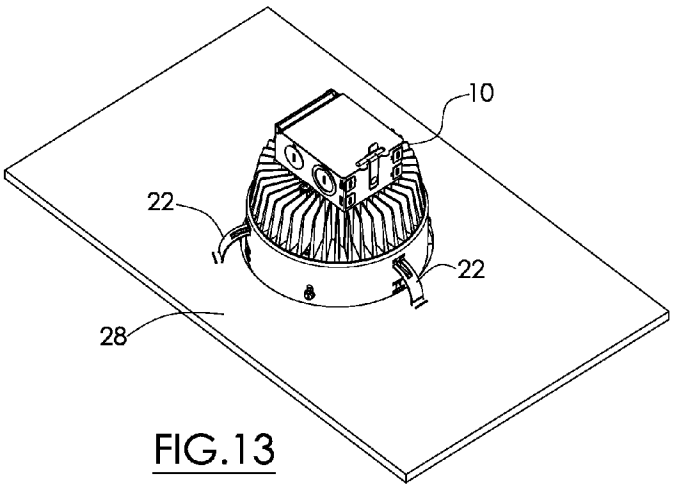
FIG. 13 is a top down view of the recessed LED light fixture kit shown in FIG. 12.
Figure 12:
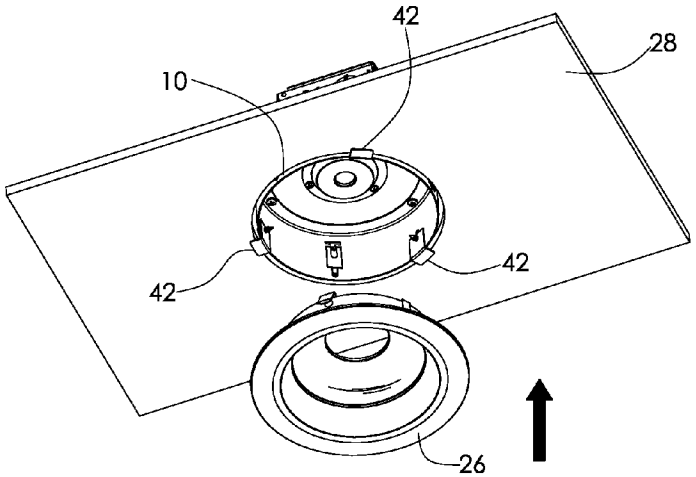
FIG. 12 is a bottom up perspective view of the recessed LED light fixture kit assembled to a ceiling panel in a remodel application.

FIGS. 12 and 13 show how the recessed LED light fixture 10 is fitted through a round hole in a ceiling panel 28. In this remodel application, the preexisting ceiling panel 28 already has the round hole where the recessed can light fixture using an incandescent, fluorescent, or halogen light source (not shown) previously stood. That obsolete recessed light fixture has been easily swapped out by the present invention LED fixture 10, which is made to fit and conform to the standard ceiling space found in most residential homes and many commercial buildings. All of the standard wiring previously used for the incandescent, fluorescent, or halogen fixture can be used to power the recessed LED light fixture 10 without modification.

As seen in the top-down and behind-the-ceiling-panel view of FIG. 13, the recessed LED light fixture kit 10 includes a plurality of spaced apart can retainer springs 22 that, when deployed as shown, act as feet to stabilize the fixture 10 on the ceiling panel 28. In the bottom-looking-up view from in front of the ceiling panel 28 of FIG. 12, a trim ring 26 with a circumferential lip 32 is attached to the bottom of the fixture 10, thus sandwiching the ceiling panel 28 between the lip 32 of the trim ring 26 and the can retainer springs 22. This is best seen in the side elevational view of FIG. 14. The fixture 10 is thusly mounted to the ceiling panel 28.

Figure 14:
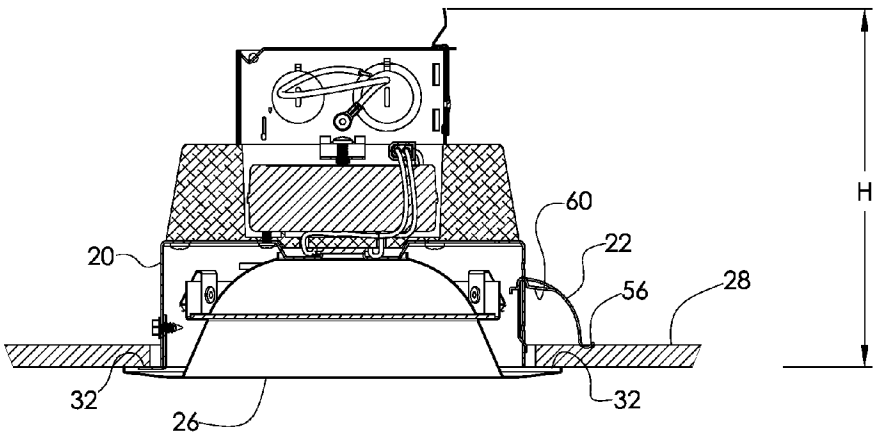
FIG. 14 is a side elevational view, partially in cross-section, of the recessed LED light fixture kit shown in FIG. 13.

One benefit of the present invention is that it has a low profile, i.e., a compact height dimension H shown in FIG. 14. In most residential homes, the ceiling joists are made from lumber having a cross-sectional dimension of about 2"×8". Thus, the realistic ceiling space behind the ceiling panel 28 up to the second story floor or attic floor is about 7¼ to 7½ inches. In some homes and patios in particular, ceiling joists are made from 2"×6" lumber, giving a ceiling space of about 5½ to 6 inches. To ensure proper fitment inside these industry standard spaces and to ensure the obsolete incandescent, fluorescent, or halogen light fixture can be swapped out without modification to the ceiling space, the recessed LED light fixture 10 in a preferred embodiment has a height H≤about 6 inches, and more preferably about 5½ inches≤H≤about 6 inches.

FIGS. 3 and 4 show the recessed LED light fixture kit 10 adapted for a new construction application where the fixture is joined to a plaster frame 30. The plaster frame 30 is a platform that carries the recessed LED light fixture kit 10 thereon and has a pair of hanger bars 34 that attach to the ceiling joists. Hanger bars 34 are known in the art as disclosed in, for example, U.S. Pat. No. 7,810,775 (Dal Ponte), the entire contents of which are incorporated by reference herein.

Figure 15:
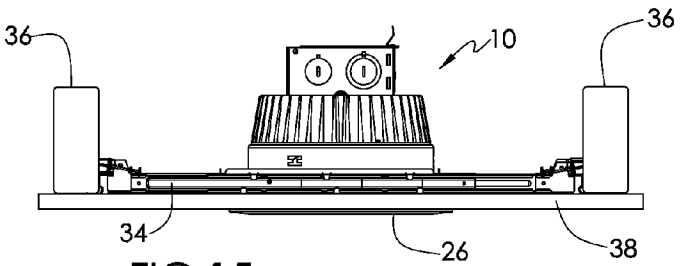
FIG. 15 is a side elevational view of the recessed LED light fixture kit of FIGS. 3 and 4 in a new construction application showing the plaster frame assembled to ceiling joists.
Figure 16:
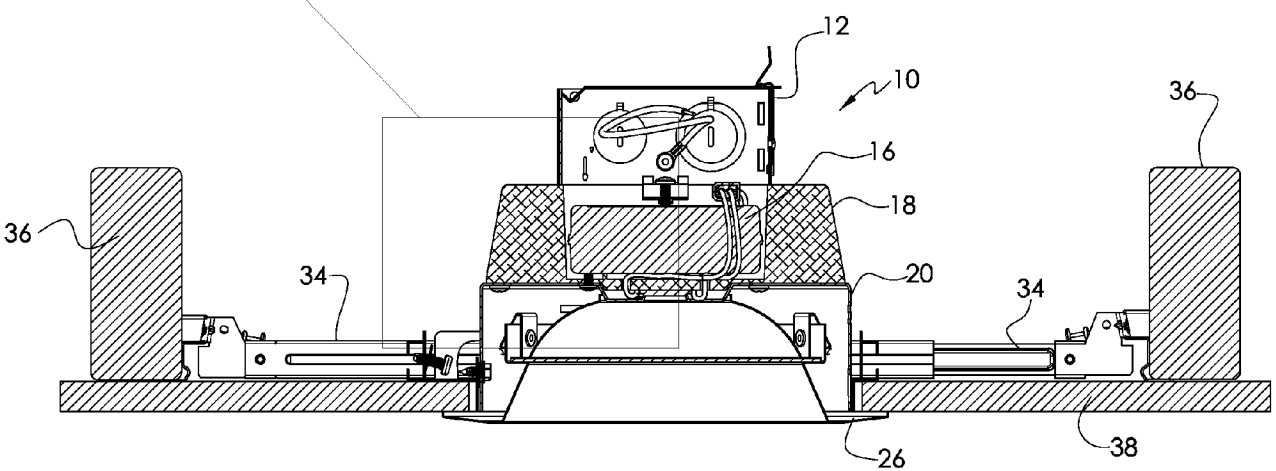
FIG. 16 is a side elevational view, partially in cross-section, of the recessed LED light fixture kit shown in FIG. 15.

FIGS. 15, 16 show the recessed LED light fixture kit 10 sitting on the plaster frame 30 and the entire assembly mounted to ceiling joists 36 using hanger bars 34. The entire assembly is positioned just above and hidden from view behind the ceiling 38. Trim ring 26 attaches to the bottom opening of the fixture 10 from underneath the ceiling 38. Accordingly, the present invention recessed LED light fixture kit is easily adapted to remodel applications or new construction applications, yet does not require retrofit of preexisting ceiling space in a remodel application, ensures fitment in preexisting ceiling spaces when replacing obsolete light fixtures, and does not require the consumer to buy extra components unique to the application.

Figure 5:
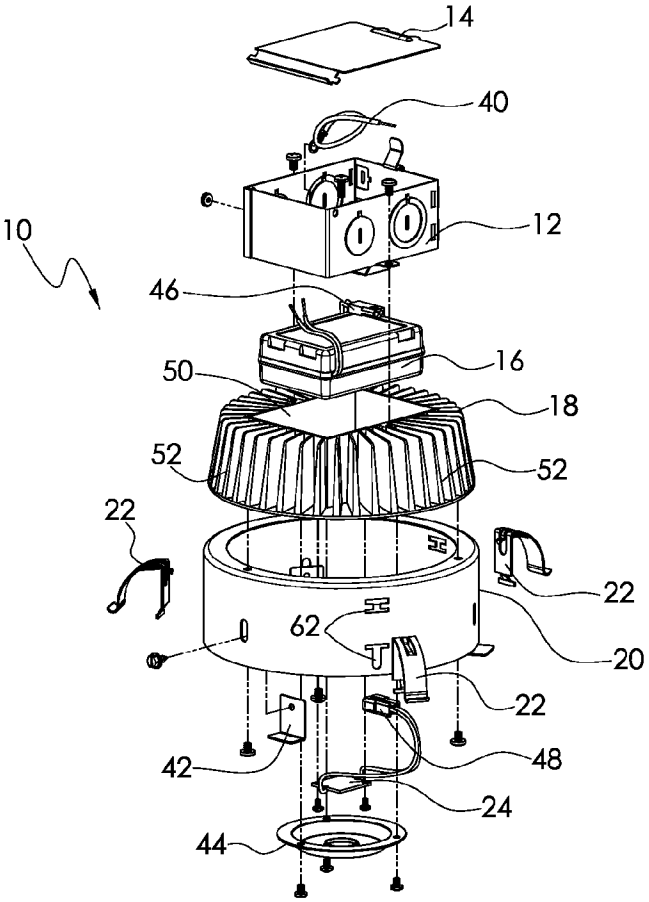
FIG. 5 is an exploded view of the FIG. 1 remodel embodiment.

FIG. 5 is an exploded view of a preferred embodiment recessed LED light fixture kit 10. At the top of the light fixture kit 10 is an electrical junction box 12 with knock outs, openings, conduits, etc., for holding electrical wiring and the ground wire 40 therein. A cover 14 is provided, which is preferably hinged to the junction box 12 for easy internal access by the electrician.

Just beneath the junction box is an LED driver 16 containing the electronics to drive the LED circuit board 24 after receiving power from a standard house AC line via the junction box 12. The light emitting LEDs (not shown) are mounted to the LED circuit board 24. The LED driver 16 is electrically wired to the LED circuit board 24 by a pair of male-female quick connects 46, 48. As a term commonly used in the art, the LED driver 16 and the LEDs 24 make up what is known as the "LED engine."

One or more LEDs, in a variety of desired wattages, colors, and arrangements are positioned on the LED circuit board 24 and face downward as seen in FIG. 2. An optional cover 44 with a center opening used to pass the LED-generated light covers and protects the LED circuit board 24.

Figure 17:
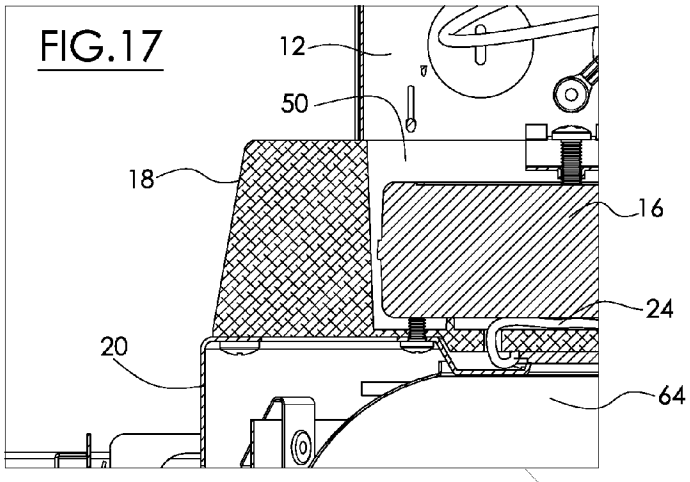
FIG. 17 is a magnified view of the heat sink and LED driver portion of the recessed LED light fixture kit shown in FIG. 16.

In the preferred embodiment shown in FIG. 5, an annular or donut-shaped heat sink 18 is provided, wherein the LED driver 16 is recessed into the center opening 50 of the heat sink 18, and the LED driver and heat sink 18 are arranged coaxially. Because LED performance and life are closely linked to their operating temperature, it is important to keep those temperatures under control. Effective cooling is important, and hence the use of the heat sink 18 and placement of the LED driver 16 recessed into and/or coaxial with the annular heat sink 18. When the LED driver 16 is embedded into the center portion of the heat sink 18 and the heat sink 18 is located directly over and abutting the LED circuit board 24, as best seen in FIGS. 16, 17, cooling of the LED driver 16 and the LED circuit board 24 through conduction and convection can be maintained efficiently.

The center opening 50 of the heat sink 18 is preferably a blind hole such that the hole has a closed bottom. The center opening 50 also has a multi-sided polygonal shape such as a square or rectangle to accommodate the standard blocky shape of the LED driver 16. The close fitment allows better heat transfer from the LED driver 16 to the heat sink 18. Other shapes for the center opening 50 are contemplated, including a circular opening. Furthermore, the fins 52 of the heat sink 18 are preferably slats that have a wedge shape to help radiate heat upwards. There are also a large number of fins 52, numbering 30 to 50 fins or more, arranged vertically and radially about the center, to dissipate heat upward and outward efficiently. Through empirical observations, the heat sink design described above appears to efficiently conduct heat away from the light fixture 10 to keep the LEDs and electronics within their normal operating temperatures.

Figure 6:
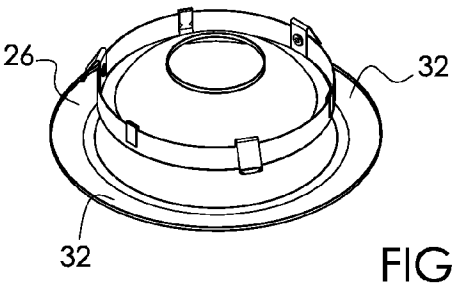
FIG. 6 is a perspective view of the trim ring in assembled form.

Just beneath the heat sink 18 is a tubular-shaped can 20 with an open top and an open bottom. The can 20 receives the heat sink 18 on top, and the two are preferably formed in one unitary piece, but can be two discrete components joined together in an assembly. Notably, the can 20 being located underneath the heat sink 18 does not enclose, envelop, or contain the heat sink therein. The open bottom of the can 20 is intended to receive a trim ring 32, shown in an assembly view in FIG. 6 and an exploded view in FIG. 7.

Figure 10:
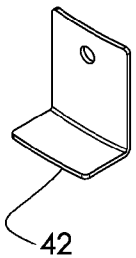

The can 20 also receives the means for mounting for the remodel application depicted in FIG. 5. The means for mounting are preferably the V-shaped can retainer springs 22, and may include optional L-brackets 42 shown in FIG. 10. As described earlier, the can retainer springs 22 when pivoted out and deployed as seen in FIGS. 13, 14, help mount the fixture 10 to the ceiling panel 28 in a remodel application. The optional brackets 42 connect to the interior of the can 20 and further brace the fixture 10 to the ceiling panel 28, as seen in FIG. 12.

To achieve a vertical compact dimension H (FIG. 14), the recessed LED light fixture 10 benefits by having the LED driver 16 being recessed into the center opening 50 of the annular heat sink 18, saving vertical space. Further, the heat sink 18, the can 20, or both are proportioned so that their aspect ratio is squat in the vertical direction. More precisely, the heat sink 18, the can 20, or both preferably have a height that is less than one-half their diameters. This proportion, through empirical observations of the heat sink in use, allows for a compact vertical dimension for the heat sink yet still efficiently fulfilling its heat dissipation function. Such an aspect ratio for the heat sink is contrary to current trends in the lighting industry. The efficient cooling results based on the squat aspect ratio was further unexpected and not predictable.

Another benefit of the present invention is the can 20 with its integration with the LED engine and heat sink, the standard can housing is no longer needed. That is, in a conventional recessed LED light fixture, there is an external can housing that encloses therein the heat sink, LED engine, and the trim (i.e., reflector, trim ring). The external can housing has the mounting hardware for the light fixture. The need for this external can housing has been eliminated in the present invention thus saving space, manufacturing and material costs.

Figure 11:
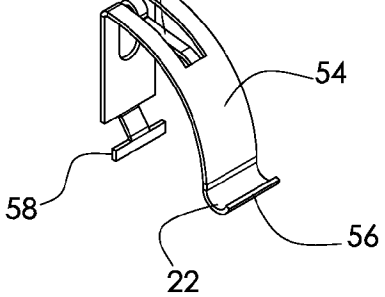
FIGS. 10 and 11 are perspective views of a bracket and a can retainer spring, respectively, used in the remodel application of the recessed LED light fixture kit shown FIG. 5.

FIG. 11 shows a preferred embodiment can retainer spring 22. It has an inverted V-shape with one leg of the "V" having a bow 54 that terminates with a curved foot 56. The foot 56 rests on the back side of the ceiling panel 28 so the curved foot 56 provides more surface area to reduce stress and the likelihood of digging into the ceiling panel 28. The bowed leg 54 gives some resilience to the support function of the can retainer spring 22. At the end of the straight leg of the "V" is a hinge 58. Slots 62 are provided on the walls of the can 20 as seen in FIG. 5. The can retainer spring 22 is positioned inside the can 20 with the bowed leg 53 extending through the slot 62 when deployed to rest on foot 56, as seen in FIG. 14. The pivoting action of the spring 22 rotates about hinge 58. When not needed, the spring 22 is pivoted about hinge 58 and refracted into the interior of the can 20. During installation of the light fixture 10, once pivoted out into the deployed position, a tab lock 60 snaps downward to press against the outside wall of the can 20 to lock the spring 22 in place.

There are preferably three of the can retainer springs 22 spaced evenly apart around the can 20 to support the fixture 10, but more or fewer springs are contemplated dependent on size, weight, shape, etc. of the fixture. Finally, no tools are needed to attach or detach the can retainer springs 22 to and from the can 20 so the consumer can easily handle this task by simple finger manipulation.

Structures similar to the pivot out can retainer springs 22 are contemplated. For example, a V-shaped spring mounted inverted as show in FIG. 5 but does not pivot in or out of the can 20 is contemplated.

Figure 7:
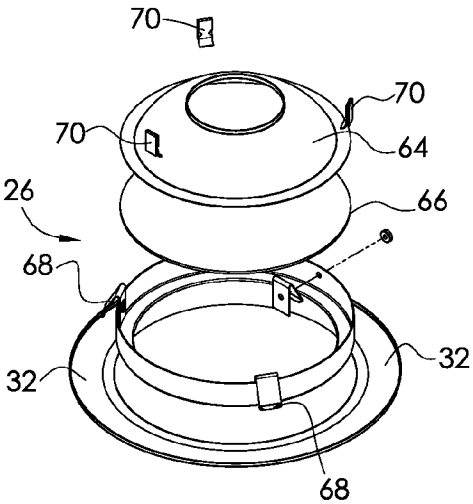
FIG. 7 is an exploded view of the trim ring shown in FIG. 6.

FIG. 7 is an exploded view of a preferred embodiment trim ring assembly 26. The trim ring 26 has a domed- or coned-shape reflector 64. Also, an optional, optical quality, flat or curved disk lens 66 is provided and frictionally held in place by spring clips 70. The consumer may at his or her discretion remove the lens 66 depending on the type of light beam desired, whether spot or area, diffused, attenuated, and/or desired color of the light. The lens 66 also fills in the open hole that is the bottom of the light fixture 10, which some consumers do not like. Multiple spring clips 68 serve to frictionally attach the trim ring 26 to the open bottom of the can 20 as indicated by the arrow in FIG. 12. This design allows the trim ring 26 to self-align in the opening of the can 20. In an alternative embodiment, coiled springs can be used in place of the spring clips 68 shown. Such a coiled spring has long legs to form a "V" where the coil is located at the vertex of the "V." The present invention design permits a variety of decorative trim rings currently on the market to be mounted to the can 20.

Figure 9:
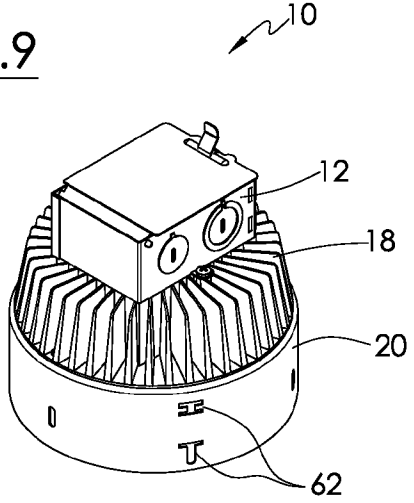
FIG. 9 is an isolated view of the recessed LED light fixture from FIG. 8.

FIG. 9 is a perspective view of a preferred embodiment recessed LED light fixture 10, without the means for mounting. The junction box 12, heat sink 18, and can 20 are assembled together. A pair of slots 62 for receiving the can retainer spring 22 can be seen in this view as well.

Figure 8:
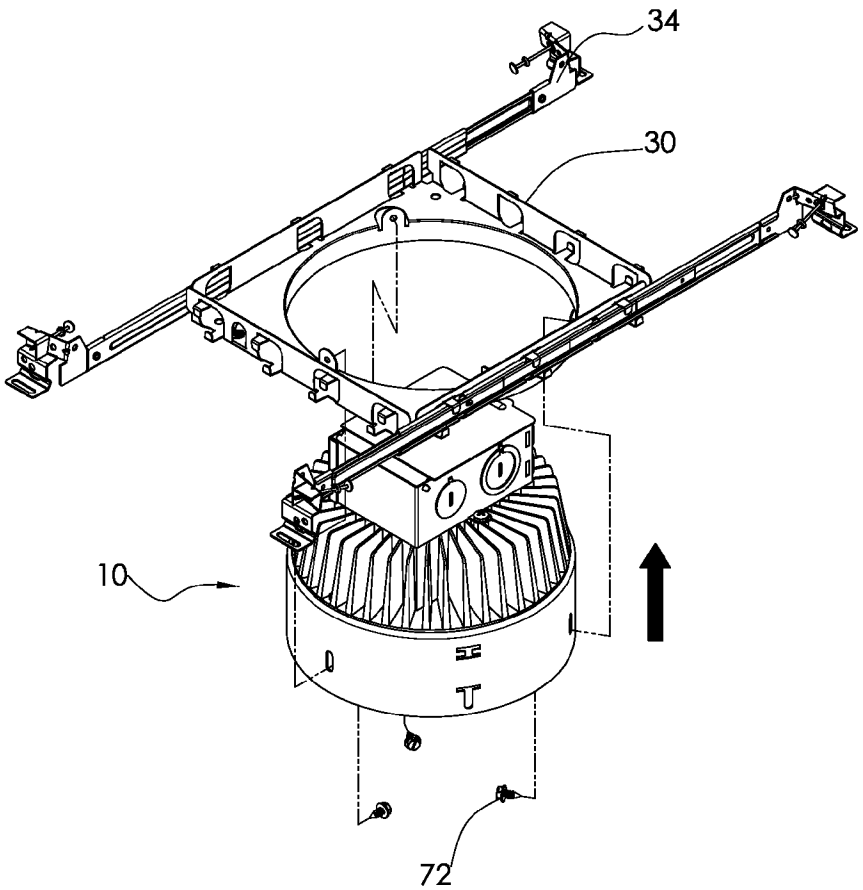
FIG. 8 is an exploded view of a preferred embodiment recessed LED light fixture kit for a new construction application for use with a plaster frame.

FIG. 8 shows the preferred embodiment recessed LED light fixture kit 10 for a new construction application. The mounting means depicted in FIG. 8, are fasteners 72, used to join the fixture 10 to the plaster panel 30 as indicated by the arrow. The means for mounting may be threaded screws 72 as shown, or rivets, bolts, flip locks, hooks, roll pins, nails, snaps, bendable tabs, or the like. There may be more or fewer than the three fasteners 72 used to attach the fixture 10 to the plaster frame 30. In this new construction application, the brackets 42 and can retainer spring 22 are not installed or used. The can retainer spring 22 or the brackets 42 if already assembled to the can 20 can be detached with finger manipulation by the consumer.

FIG. 17 provides a magnified, cross-sectional view of the LED driver 16 and heat sink 18 arrangement. In this preferred embodiment, the height of the LED driver 16 is less than the height of the heat sink 18, so that the LED driver 16 is completely recessed into the center opening 50. The bottom of the LED driver 16 directly contacts the heat sink 18, and the top of the LED circuit board 24 directly contacts the heat sink 18 at its top. These contacts improve heat conduction. Thermal conducting adhesives or materials may optionally be added to the interface for improved heat transfer to the heat sink 16.

Figure 20:
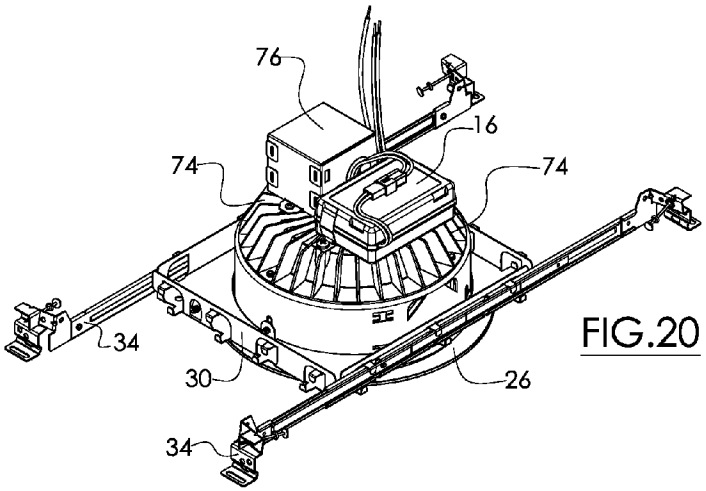
FIGS. 18-21 show an alternative embodiment kit wherein the LED driver is not recessed into the heat sink.
Figure 21:
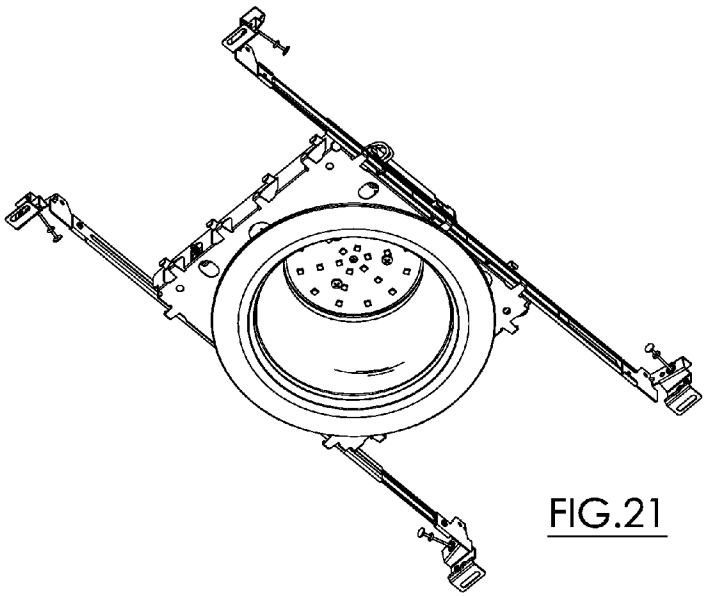
Figure 18:
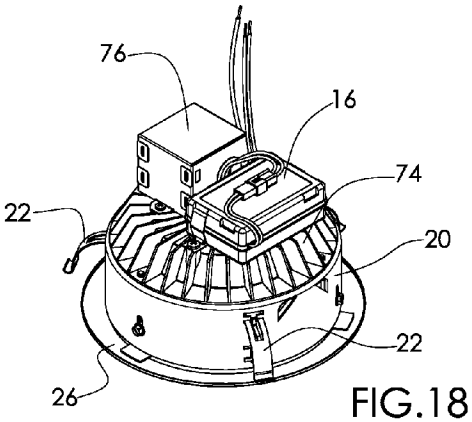
Figure 19:
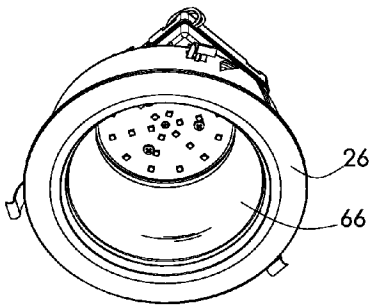

FIGS. 18-21 show an alternative embodiment kit wherein the LED driver 16 is disposed on top of the heat sink 74 and is not recessed inside the heat sink 74. In this alternative embodiment, the junction box 76 rests side-by-side with the LED driver 16. The heat sink 74 is disposed on top of the open top of the tubular-shaped can 20. The open bottom of the can 20 receives the trim ring 26 with optional lens 66 installed. FIGS. 18-19 show the remodel application and FIGS. 20-21 show the new construction application. The compact height dimension is still met in this embodiment, because the LED driver 16 occupies less vertical space than the junction box 76. In still yet another alternative embodiment (not shown), the heat sink and LED driver may be arranged side-by-side on top of the can. The heat sink may be a half-crescent, wedge, or semicircular in shape and abut against the LED driver along the side of the heat sink. The junction box still sits atop the heat sink.

Unless otherwise described herein, conventional materials and manufacturing methods may be used to make the present invention. Additionally, various modifications may be made to the present invention without departing from the scope thereof. Although individual features of embodiments of the invention may be shown in some of the drawings and not in others, those skilled in the art will recognize that individual features of one embodiment of the invention can be combined with any or all of the features of another embodiment.

We claim:

1. A recessed ceiling light fixture kit for installation to a ceiling panel or a plaster frame, comprising:

an LED engine including at least one LED facing downward and an LED driver;

an annular shaped heat sink having a polygonal shaped center opening, wherein the LED driver is disposed within the polygonal shaped center opening such that the height of the LED driver is recessed beneath the height of the heat sink;

wherein the annular shaped heat sink includes an aspect ratio defined by a height that is less than about ½ the diameter, and wherein the LED is disposed underneath the heat sink;

a tubular-shaped can with an open bottom and a top formed integrally with the heat sink in an unitary assembly;

means for mounting disposed on the unitary assembly for mounting the unitary assembly to one of the ceiling panel and the plaster frame, wherein the means for mounting can be separated from the unitary assembly;

a junction box disposed on the unitary assembly; and a trim ring attached to the open bottom of the can.

2. The recessed ceiling light fixture kit of claim 1, wherein the means for mounting includes at least one of (a) pivoting can retainer springs that swivel into and out of the unitary assembly and anchor to the ceiling panel, and (b) threaded fasteners that attach to the plaster frame.

3. The recessed ceiling light fixture kit of claim 2, wherein the pivoting spring clips have a V-shape with curved foot.

4. The recessed ceiling light fixture kit of claim 1, wherein the heat sink includes radially, spaced apart, slat shaped fins with the fins having a wedge profile.

5. The recessed ceiling light fixture kit of claim 1, wherein the junction box is mounted on top of the heat sink outside of the can.

6. The recessed ceiling light fixture kit of claim 1, wherein the trim ring includes a reflector.

7. The recessed ceiling light fixture kit of claim 1, wherein the means for mounting includes at least one of (a) a pivoting can retainer spring having a V-shape that is pivotably mounted to the can, and (b) a fastener and bracket combination that attach the can to the plaster frame.

8. The recessed ceiling light fixture kit of claim 1, wherein the trim ring includes at least one of spring clips and coiled springs that attach the trim ring to the interior of the can under spring bias.

9. The recessed ceiling light fixture kit of claim 1, wherein the can does not enclose the junction box and the heat sink.

10. A recessed ceiling light fixture kit for installation to a ceiling panel or plaster frame, comprising:

an LED engine including at least one LED facing downward and an LED driver;

an annular shaped heat sink that receives the LED driver within a polygonal shaped center opening so that the height of the LED driver is recessed beneath the height of the heat sink and the LED is disposed underneath the heat sink such that the LED driver is located directly over and abutting the LED;

wherein the annular heat sink includes an aspect ratio defined by a height that is less than about ½ the diameter;

a tube-shaped can having an open bottom with the heat sink disposed at the top in an unitary assembly;

a detachable means for mounting disposed on the can at its circumference for mounting the can to one of the ceiling panel and the plaster frame;

a trim ring joined to the can at the open bottom; and a junction box disposed on top of the heat sink.

11. The recessed ceiling light fixture kit of claim 10, wherein the means for mounting includes pivoting can retainer springs that swivel into and out of the can for installation, which pivoting retainer springs are snapped into position on the can.

12. The recessed ceiling light fixture kit of claim 10, wherein the annular heat sink includes an aspect ratio defined by a height that is less than about ½ the diameter.

13. The recessed ceiling light fixture kit of claim 10, wherein the can is cylindrical and includes an aspect ratio defined by a height that is less than about ½ the diameter.

14. The recessed ceiling light fixture kit of claim 10, wherein the trim ring includes a removable lens.

15. The recessed ceiling light fixture kit of claim 10, wherein the overall height H of the light fixture is defined by $H \leq 6$ inches.

16. A recessed ceiling light fixture kit for installation to a ceiling panel or plaster frame, comprising:

an LED engine including at least one LED facing downward and an LED driver;

an annular shaped heat sink having a polygonal shaped center opening that receives the LED driver therein such that the height of the LED driver is recessed beneath the height of the heat sink, wherein the annular heat sink includes an aspect ratio defined by a height that is less than about ½ the diameter, and wherein the LED is disposed underneath the heat sink;

a tubular can having an open bottom and a top engaging the heat sink in an unitary assembly;

at least one of a detachable can retainer spring and a threaded fastener engaging the can at its circumference, wherein the retainer spring mounts to the ceiling panel and the threaded fastener attaches the plaster frame;

a trim ring joined to the can at the open bottom; and a junction box disposed on top of the unitary assembly.

17. The recessed ceiling light fixture kit of claim 16, wherein the trim ring includes a removable lens having a flat disk shape.

18. The recessed ceiling light fixture kit of claim 16, wherein the heat sink includes a plurality of vertically oriented, radially spaced apart fins, and the fins include a wedge shape.

19. The recessed ceiling light fixture kit of claim 16, wherein the can includes an aspect ratio defined by a height that is less than the radius.

20. The recessed ceiling light fixture kit of claim 16, wherein the fixture includes at least one of spring clips and torsion springs to join the trim ring to the open bottom of the can.

* * * * *